US005666718A

United States Patent [19]

Onishi et al.

[11] Patent Number: 5,666,718

[45] Date of Patent: Sep. 16, 1997

[54] TERMINAL INSERTING APPARATUS

[75] Inventors: Hideo Onishi; Kenichi Taniguchi, both of Yokkaichi, Japan

[73] Assignee: Sumitomo Wiring Systems, Ltd., Mie, Japan

[21] Appl. No.: 565,919

[22] Filed: Dec. 1, 1995

[30] Foreign Application Priority Data

Dec. 8, 1994 [JP] Japan ..... 6-305034

[51] Int. Cl.[6] ..... H01R 43/20

[52] U.S. Cl. ..... 29/748; 29/33 M; 29/754; 29/755; 29/759

[58] Field of Search ..... 29/33 M, 747, 29/748, 754, 759, 881, 755, 845

[56] References Cited

U.S. PATENT DOCUMENTS

| | | | |
|---|---|---|---|
| 4,835,844 | 6/1989 | Gerst et al. | 29/747 |
| 5,109,602 | 5/1992 | Fukuda et al. | 29/748 X |
| 5,355,583 | 10/1994 | Osumi et al. | 29/759 X |
| 5,457,875 | 10/1995 | Ohta et al. | 29/748 X |
| 5,459,924 | 10/1995 | Ohsumi et al. | 29/881 |

FOREIGN PATENT DOCUMENTS

| | | | |
|---|---|---|---|
| 534882 | 3/1993 | European Pat. Off. | 29/748 |
| 60-47304 | 3/1985 | Japan | 29/748 |
| 63-45780 | 2/1988 | Japan | 29/748 |
| 63-170874 | 7/1988 | Japan | 29/748 |
| 63-164181 | 7/1988 | Japan | 29/748 |
| 1-313872 | 12/1989 | Japan | 29/747 |
| 3-274690 | 12/1991 | Japan | 29/747 |
| 3-283285 | 12/1991 | Japan | 29/747 |
| 5-6791 | 1/1993 | Japan | 29/748 |
| 5-82231 | 4/1993 | Japan | 29/748 |
| 6-52962 | 2/1994 | Japan | 29/748 |
| 6-187852 | 7/1994 | Japan | 29/748 |

OTHER PUBLICATIONS

English Abstract of Japanese Patent Laid–Open Publication No. 6–52962.

*Primary Examiner*—Peter Vo

*Attorney, Agent, or Firm*—Beveridge, DeGrandi, Weilacher & Young, LLP

[57] ABSTRACT

A rotation regulating mechanism (43) is disposed on a terminal chuck (41) for holding a wired terminal (T). The rotation regulating mechanism (43) is arranged to regulate the rotation of the wired terminal (T), allowing an operation of inserting the wired terminal (T). Even if the terminal chuck (41) has to receive a wired terminal (T) from a terminal positioning device (30) having an inverting function, the rotation or positional shift of the wired terminal (T) can be regulated.

7 Claims, 11 Drawing Sheets

TERMINAL INSERTING APPARATUS

TECHNICAL FIELD OF THE INVENTION

The present invention relates to a terminal inserting apparatus and more particularly to a terminal inserting apparatus for automatically inserting a terminal, secured to an end of an electric wire (hereinafter referred to as a wired terminal), into a connector housing.

RELATED BACKGROUND ART

A variety of apparatuses for automatically inserting a wired terminal into a connector housing have conventionally been proposed and put into practical use (See Japanese Patent Laid-Open Publication Nos. 3-283285, 3-274690, 60-47304, 63-45780, 63-164181, 63-170874, 1-313872, 5-6791, 5-82231.

Most of the conventional apparatuses have a terminal chuck for guiding a wired terminal and a wire chuck for holding the electric wire of the wired terminal at the vicinity of the terminal chuck and acts an inserting operation in such a way that the wired terminal, positioned by the terminal chuck, is faced to the corresponding cavity or the terminal housing chamber of a connector housing and is then inserted, along the terminal chuck, by the wire chuck.

In such a prior art, a wired terminal is received from a holding mechanism which holds the wired terminal, or a delivery mechanism for delivering a wired terminal.

Recently, a so-called terminal positioning device has been developed and has been equipped with the terminal inserting apparatus above-mentioned (See Japanese Patent Laid-Open Publication Nos. 3-283285, 3-274690. The applicant of the present invention has developed a terminal positioning device which can act, when the wired terminal is delivered to a terminal inserting apparatus, not only for providing a holding position of the wired terminal to the chucks, but also for correcting the posture of the wired terminal to be inserted into the terminal housing chamber of a connector housing. That is, inserting operation of some types of the wired terminal is conducted in such a way that the wired terminal is primarily twisted or rotated around an axis of the electric wire (hereinafter referred to as "inverted") and is then inserted into a terminal housing chamber of a connector housing by delivering the inverted wired terminal to the inserting apparatus upon maintaining the inverted posture.

There is a disadvantage in the conventional arrangement in that the inverted wired terminal often turns back its posture when it is delivered from the terminal positioning device to the terminal inserting apparatus, so that the predetermined inserting operation can not be conducted.

More specifically, in a terminal inserting apparatus of prior art, it is required to guide a wired terminal along the terminal chuck at the time of a terminal inserting operation. It is therefore required to form a gap between the terminal chuck and the terminal of the wired terminal. To cope with a variety of types of wired terminals, such a gap is formed as set to the largest terminal. As a result, when a wired terminal has a terminal small in size, such a wired terminal is merely loosely guided by the terminal chuck. This disadvantageously lowers the precision. Accordingly, when the inverted wired terminal is received from a terminal positioning device having a terminal inverting function, the terminal turns back due to the reaction force developed in the electric wire when the terminal is inverted at the time of delivery. This may often provoke an insertion mistake.

The inverting operation above-mentioned is not always executed on all wired terminals. It is therefore required that the terminal chuck guides both inverted and non-inverted wired terminals. However, the arrangement of prior art above-mentioned is not provided with a function of guiding wired terminals which respectively assume different postures.

An object of the present invention is to provide a terminal inserting apparatus capable of securely receiving a wired terminal from a terminal positioning device having an inverting function and also capable of inserting, in a proper posture, the wired terminal to a connector housing.

DISCLOSURE OF THE INVENTION

The present invention is directed to a terminal inserting apparatus for achieving this need.

According to a preferred mode of the present invention, the terminal inserting apparatus is provided with a terminal chuck for guidably holding a wired terminal, a wire chuck for holding the electric wire of the wired terminal and for inserting the wired terminal into a connector housing in association with the terminal chuck by which the wired terminal is being held and a rotation regulating means for regulating the posture of the wired terminal held by the terminal chuck in a state where the wired terminal is only relatively movable with respect to the terminal chuck when the wire chuck acts an inserting operation. According to the arrangement above-mentioned, when the terminal chuck holds a wired terminal from the terminal positioning device, the rotation regulating means regulates the displacement of the wired terminal in the state where the wired terminal is only relatively movable with respect to the terminal chuck when the wire chuck acts an inserting operation. Accordingly, the rotation regulating means regulates, in a predetermined state, the displacement of the wired terminal delivered to the terminal chuck. Thus, even though a wired terminal has been inverted, such a wired terminal can advantageously be inserted with the inverted posture of the wired terminal securely maintained.

According to a further preferred mode of the present invention, the terminal chuck includes a pair of end surfaces for holding a wired terminal carried by a terminal positioning device, and a bottom surface extended from at least one of the end surfaces for receiving a bottom of the wired terminal held between the end surfaces. The rotation regulating means includes biasing members for resiliently biasing the wired terminal, held between the end surfaces, onto the bottom surface. According to the arrangement above-mentioned, the biasing members of the rotation regulating means can resiliently bias the surrounded wired terminal onto the bottom surface by the biasing members in association with the end surfaces and the bottom surface extending from at least one of the end surfaces. Accordingly, regardless of the size and posture, the wired terminal positioned by the terminal positioning device can advantageously be inserted as maintained at a proper posture.

Thus, the present invention produces the remarkable effects that a wired terminal can securely be received from the terminal positioning device having an inverting function and that any of a variety of types of wired terminals can be inserted in a proper posture.

These and other features, objects and advantages of the present invention will be more fully apparent from the following detailed description set forth below when taken in conjunction with the accompanying drawings.

DESCRIPTION OF THE PREFERRED EMBODIMENTS

The following description will discuss a preferred embodiment of the present invention with reference to the attached drawings.

Figure 1:
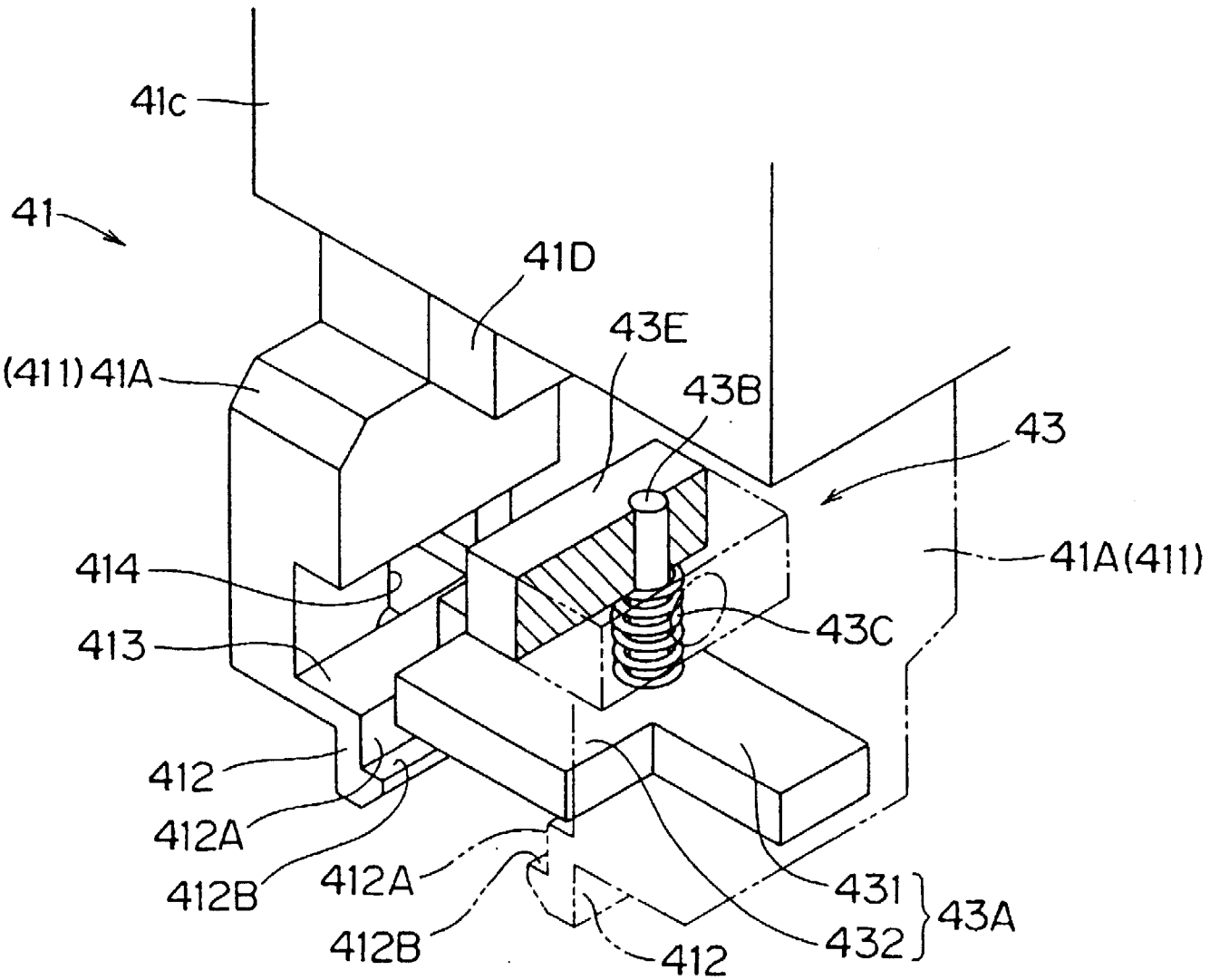
FIG. 1 is a perspective view, partially broken away, of main portion of a terminal inserting apparatus according to an embodiment of the present invention.
Figure 2:
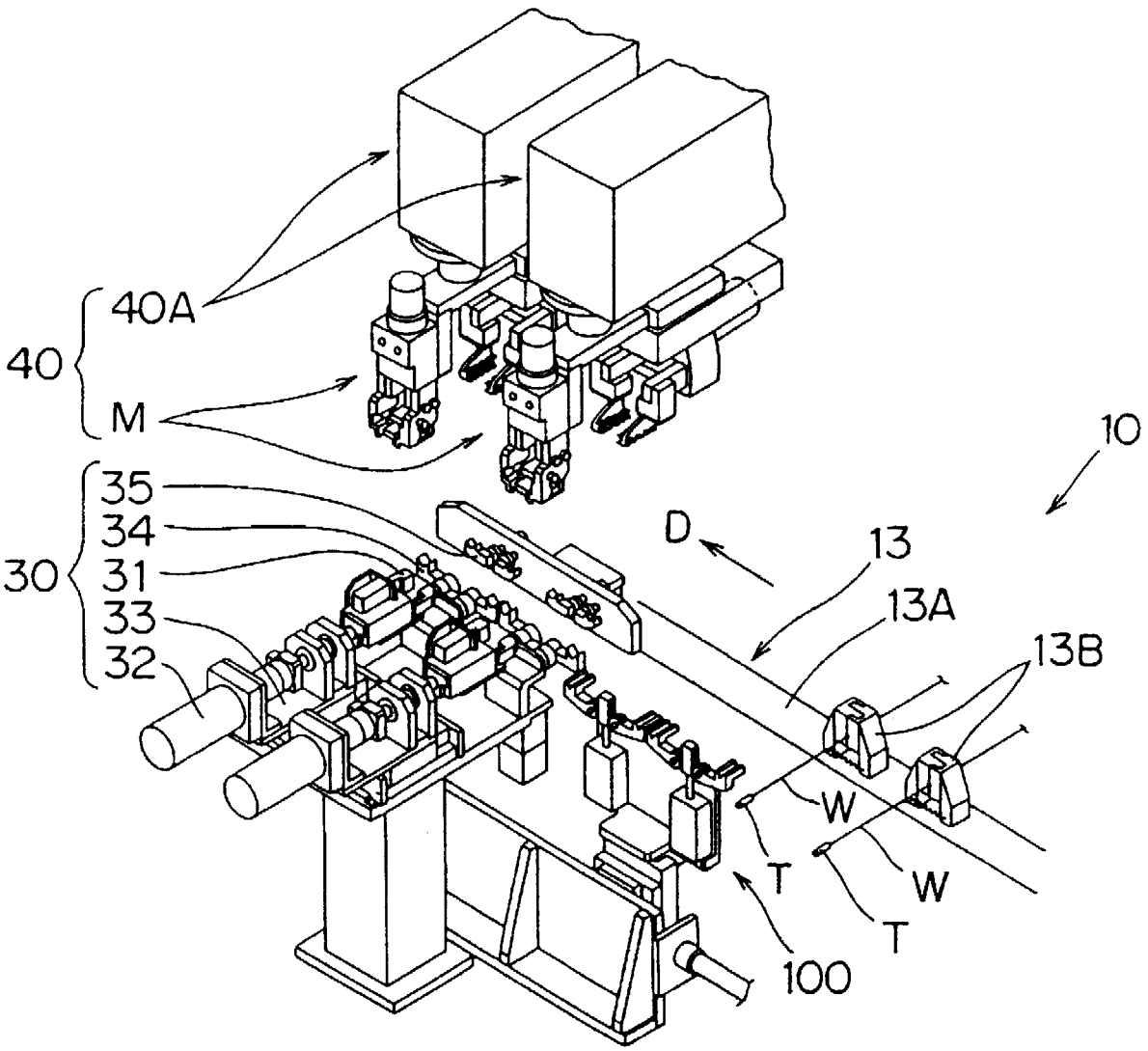
FIG. 2 is a perspective view of main portions of a wire harness producing apparatus employing the terminal inserting apparatus in FIG. 1.
Figure 3:
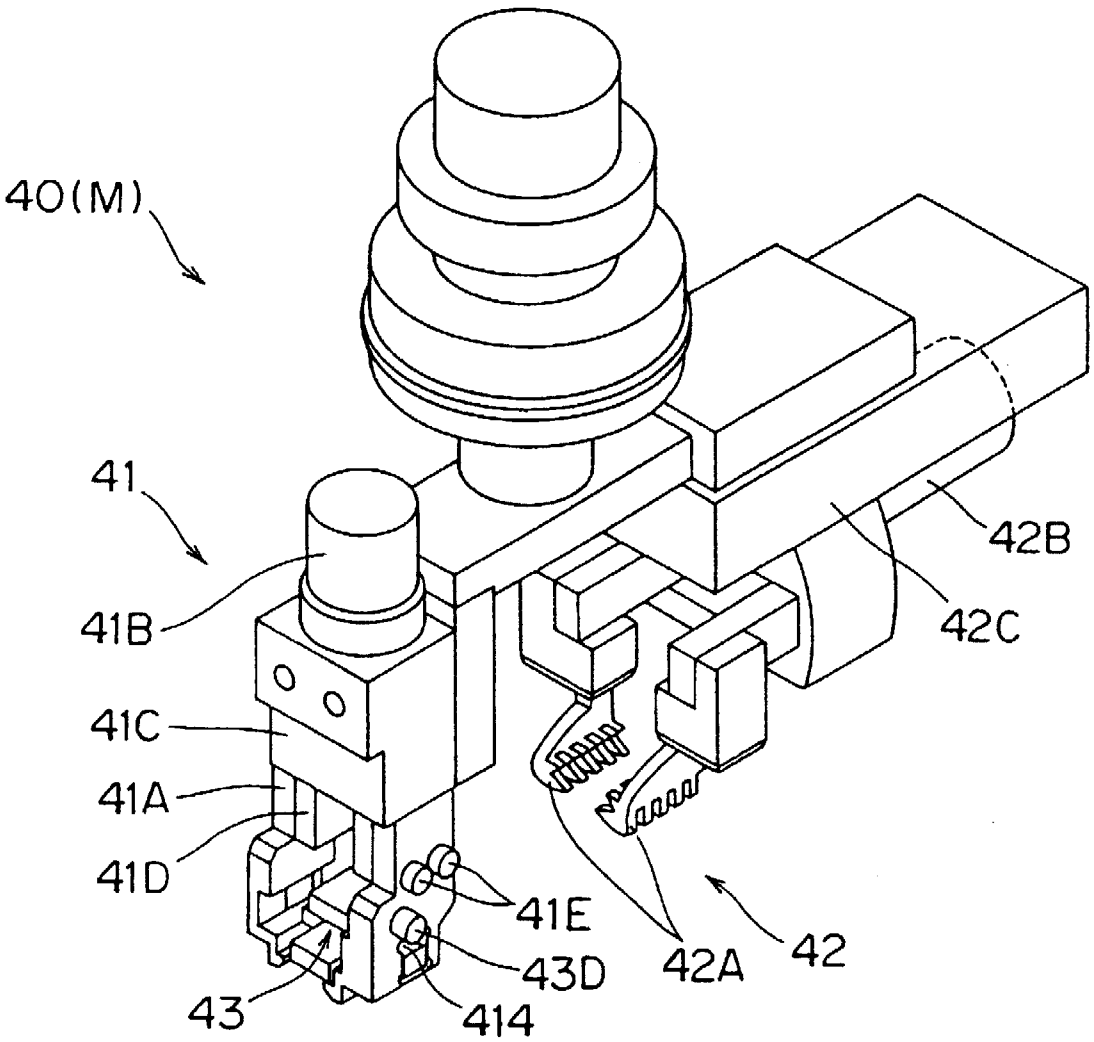
FIG. 3 is a perspective view illustrating the appearance of the terminal inserting apparatus in FIG. 1.
Figure 4:
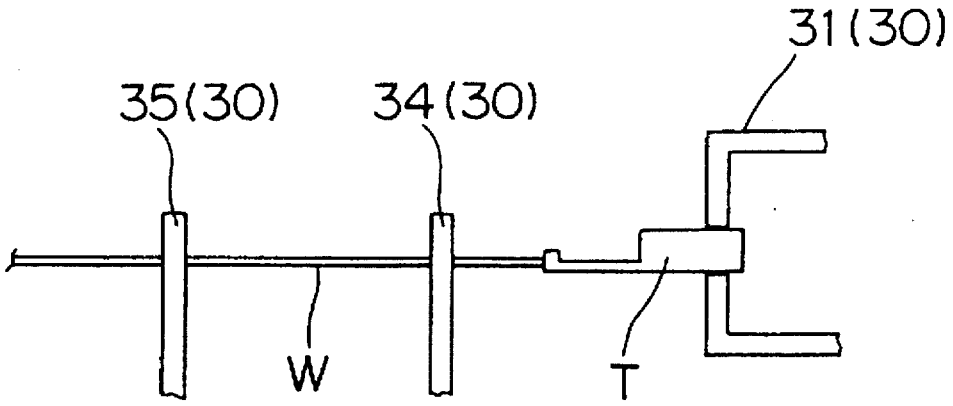
FIG. 4 is a schematic side view illustrating a terminal inserting operation in the embodiment in FIG. 1.

FIG. 1 is a perspective view, with portions broken away, of main portions of a terminal inserting apparatus according to an embodiment of the present invention, FIG. 2 is a perspective view of main portions of a wire harness producing apparatus employing the terminal inserting apparatus in FIG. 1, and FIG. 3 is a perspective view illustrating the appearance of the terminal inserting apparatus in FIG. 1.

Referring to FIG. 2, an automatic wire harness producing system 10 that relates to the present invention has a wire conveying device 13 for conveying a wired terminal T that has been manufactured through a known process. The wire conveying device 13 has an endless belt 13A and pairs of clamp jigs 13B attached to the outer peripheral surface of the endless belt 13A with spatial intervals provided among the clamp jigs 13B. The wire conveying device 13 is a known conveyor arranged such that a sheathed wire W is conveyed in a predetermined horizontal direction (hereinafter referred to as wire conveying direction) D by rotating the endless belt 13A while a pair of clamp jigs 13B respectively hold one end and the other end of the sheathed wire W of wired terminals T such that the intermediate portion of the sheathed wire W hangs down substantially in a U shape. In this embodiment, the ends of the sheathed wire W clamped by the clamp jigs 13B are located in a direction horizontally perpendicular to the wire conveying direction D.

Disposed downward of a downstream end of the wire conveying device 13 in the wire conveying direction D is a terminal positioning device 30 for positioning a wired terminal T in a circumferential direction of the sheathed wire W. The terminal positioning device 30 is arranged to receive the sheathed wire W from a wire delivering device 100. Provision is made such that, after the sheathed wire W is conveyed to the terminal positioning device 30 and the terminals are subjected to a positioning process by the terminal positioning device 30, the sheathed wire W is connected to a connector housing C (See FIG. 11) by a terminal inserting device 40 disposed downstream of the terminal positioning device 30, and that the sheathed wire W is then collected by a collecting device (not shown).

The terminal positioning device 30 has two sets of holding jaws 31 for holding the tips of wired terminals T, rotary actuators 32 for inverting each holding jaw 31, and advance or retreat unit 33 for integrally advancing or retreating each holding jaw 31 and each rotary actuator 32 in a horizontal direction perpendicular to the wire conveying direction D. Set at each holding jaw 31 are a centering clamp 34 for positioning the sheathed wire W of the wired terminal T and a wire bringing clamp 35 for bringing the sheathed wire W to the centering clamp 34, by which the sheathed wire W of the wired terminal T is delivered from the wire delivering device 100 to the clamps 34 and 35. The terminal positioning device 30 is so arranged as to receive a pair of wire terminals T secured to both ends of sheathed wire W delivered from the clamps 34 and 35 and to invert predetermined one, thereby positioning the both terminals T such that each terminal T can be held by a terminal inserting apparatus 40, which will be discussed later, to which the terminals T are delivered.

The following description will discuss the terminal inserting device 40 according to this embodiment.

As shown in FIG. 3, the terminal inserting device 40 according to this embodiment has two sets of terminal chucks 41 and wire chucks 42, both of which form a pair of manipulators M (See FIG. 2). Terminal inserting device 40 includes a pair of conveyance drive devices 40A of a known type (shown only in FIG. 2) by which each manipulator M are conveyed, as discussed later, for receiving the terminals T from the terminal positioning device 30 in order to insert each terminal T into a terminal inserting chamber C1 of a connector housing C.

Each terminal chuck 41 is arranged to hold guidably a wired terminal T carried by the terminal positioning device 30. In this embodiment, each terminal chuck 41 has a pair of holding jaws 41A for holding the wired terminal T, held between the holding jaws 31 of the terminal positioning device 30, in such a way that the wired terminal T is held from sideways between the holding jaws 41A, and an actuator 41B for opening or closing the holding jaws 41A. The actuator 41B is disposed on an upper portion of a terminal-side block body 41C and has opening/closing jaws 41D which extend downward of the terminal-side block body 41C. The holding jaws 41A are secured to the opening/closing jaws 41D by bolts 41E. Accordingly, when the opening/closing jaws 41D are transversely displaced, the holding jaws 41A also are transversely displaced such that a wired terminal T can releasably be held between the holding jaws 41A.

Referring to FIG. 1, each holding jaw 41A has, in a unitary structure, a block body 411 secured to the corresponding opening/closing jaw 41D of the actuator 41B and a guide portion 412 disposed under the block body 411 for guiding a wired terminal T.

The guide portions 412 and 412 of the holding jaws 41A are horizontally close one another. Each of the guide portions 412 has, in a unitary structure, an end surface 412A for receiving a lateral side of a wired terminal T to be guided, and a bottom surface 412B which extends perpendicularly from the end surface 412A to receive the bottom of the wired terminal T. As will be discussed later, the wired terminal T, which is held by the holding jaws 31 of the terminal positioning device 30, will be guided insertion allowably toward a connector housing C in such a way that lateral portions of the wired terminal T are held by the end surfaces 412A while a bottom portion of the wired terminal T is being received by the bottom surfaces 412B.

Back to FIG. 3, each wire chuck 42 is arranged to hold the sheathed wire W of a wired terminal T carried by the terminal positioning device 30 and to insert the wired terminal T into the connector housing C in association with the terminal chuck 41 by which the wired terminal T is being held. Likewise in a known terminal inserting apparatus, each wire chuck 42 includes a pair of comb teeth jaws 42A for holding a sheathed wire W, an opening/closing actuator 42B for opening/closing the comb teeth jaws 42A, and an inserting actuator 42C which integrally carries the comb teeth jaws 42A and the opening/closing actuator 42B in order to drive the comb teeth jaws 42A toward the terminal chuck 41 such that the wired terminal T is inserted.

In the arrangement above-mentioned, terminal chucks 41 in this embodiment include a rotation regulating mechanism 43 for regulating the displacement, in particular the rotation, of the wired terminal T held by the terminal chuck 41 in the state where the wired terminal is only relatively movable with respect to the terminal chuck when the wire chuck acts an inserting operation.

According to this embodiment, the rotation regulating mechanism 43 includes a pressing plate 43A disposed between the holding jaws 41A of the terminal chuck 41, a slide pin 43B secured to the pressing plate 43A, a compression coiled spring 43C through which the slide pin 43B passes, and a stationary piece 43E secured to one of the holding jaws 41A with a bolt 43D (See FIG. 3) for making the compression coiled spring 43C flex between the pressing plate 43A and the stationary piece 43E.

The pressing plate 43A is formed by a plate member substantially in a T shape in plan view which integrally has a pair of drive pieces 431 which are capable of press-contacting with shoulder portions 413 defined by the inner surfaces of the block bodies 411 and the top surfaces of the guide portion 412 of the holding jaws 41A, and a pressing piece 432 which extends from the drive piece 431 and which press-contacts with the top surface of the wired terminal T. Each drive piece 431 is vertically opposite to the bottom surfaces 412B of the guide portions 412 of the terminal chuck 41.

Each slide pin 43B extends vertically and has a base end which is secured to the drive piece 431 of the pressing plate 43A and which extends upwardly. On the other hand, the slide pin 43B has an upper end passing through the stationary piece 43E such that the slide pin 43B is relatively displaceable with respect to the stationary piece 43E. In association with the stationary piece 43E, the slide pin 43B vertically movably guides the pressing plate 43A.

The compression coiled spring 43C is compressively disposed between the pressing plate 43A and the stationary piece 43E such that the pressing plate 43A is biased downwardly, i.e., toward the bottom surfaces 412B of the guide portions 412. This embodiment is arranged such that the pressing plate 43A can push a wired terminal T to the bottom surfaces 412B with a predetermined load by setting the pressing force of the compression coiled spring 43C to a predetermined value. As a result, the pressing plate 43A and the bottom surfaces 412B regulate the displacement of the wired terminal T in the state where the wired terminal is only relatively movable with respect to the terminal chuck when the wire chuck acts an inserting operation.

As mentioned in the foregoing, each terminal chuck 41 is arranged such that its holding jaws 41A are moved toward each other to hold a wired terminal T therebetween. To prevent the holding jaws 41A from interfering with the rotation regulating mechanism 43, each of the holding jaws 41A is provided in its lateral side with an insertion hole 414.

The following description will discuss the operation of the embodiment with reference to FIGS. 4 to 16.

Figure 5:
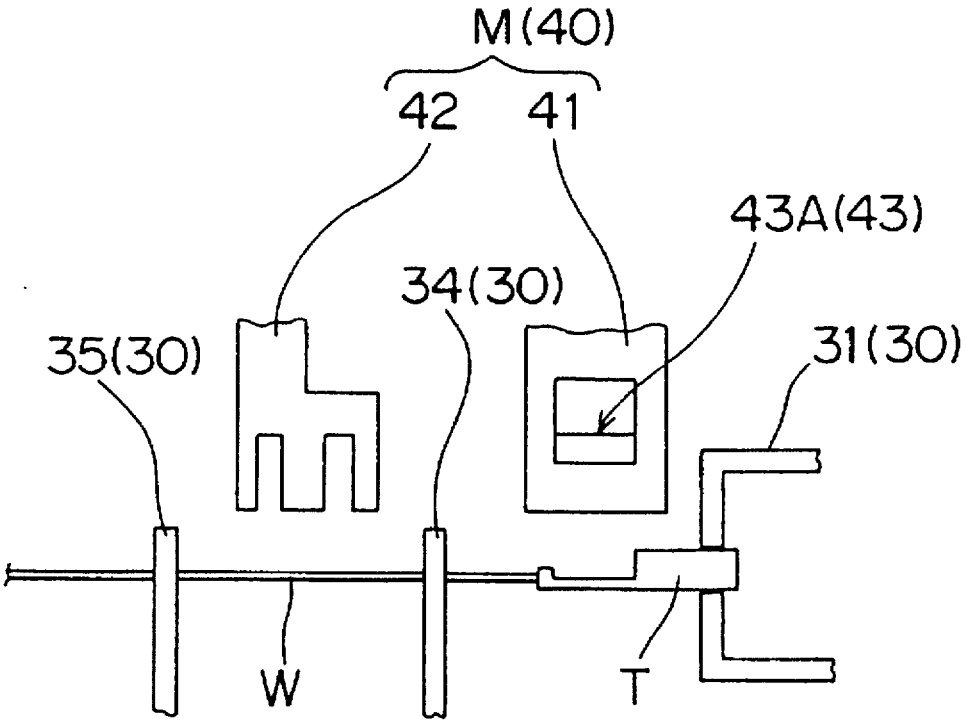
FIG. 5 is a schematic side view illustrating a terminal inserting operation in the embodiment in FIG. 1.
Figure 6:
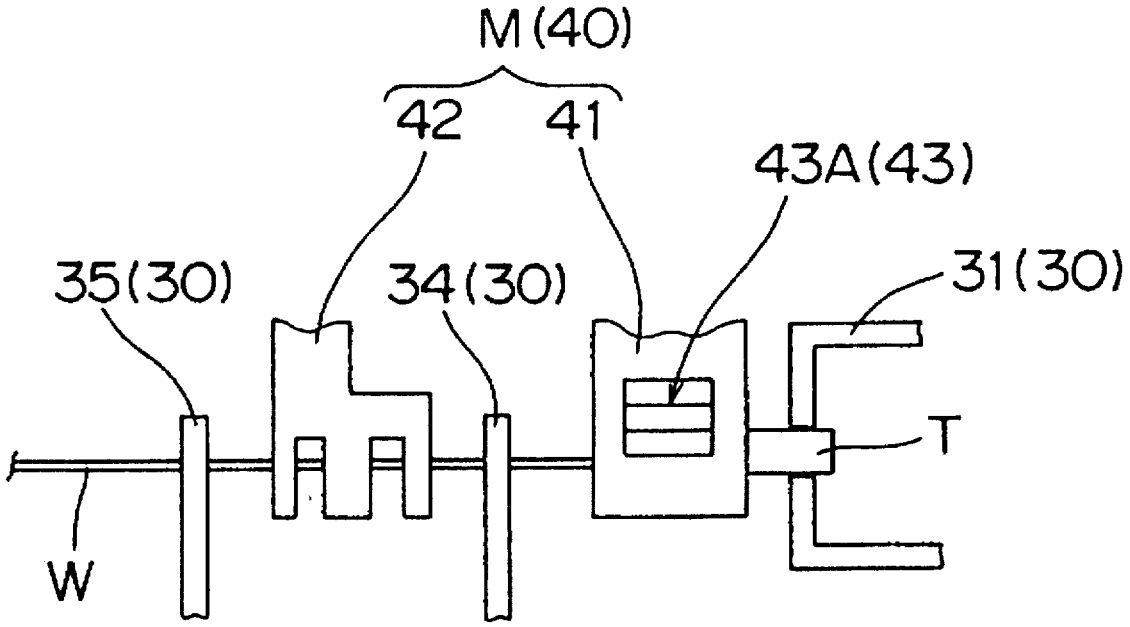
FIG. 6 is a schematic side view illustrating a terminal inserting operation in the embodiment in FIG. 1.
Figure 7:
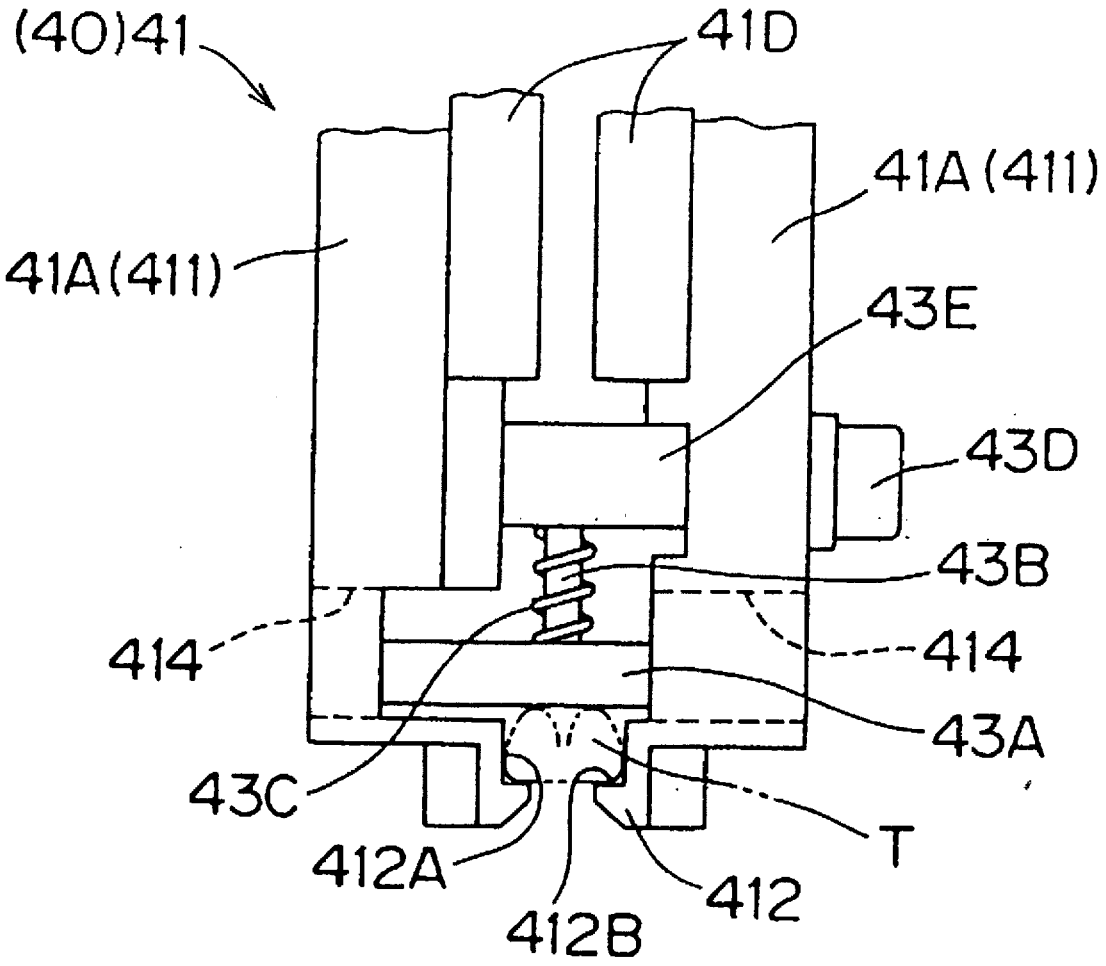
FIG. 7 is a schematic front view illustrating how a wired terminal is guided in the embodiment in FIG. 1.
Figure 8:
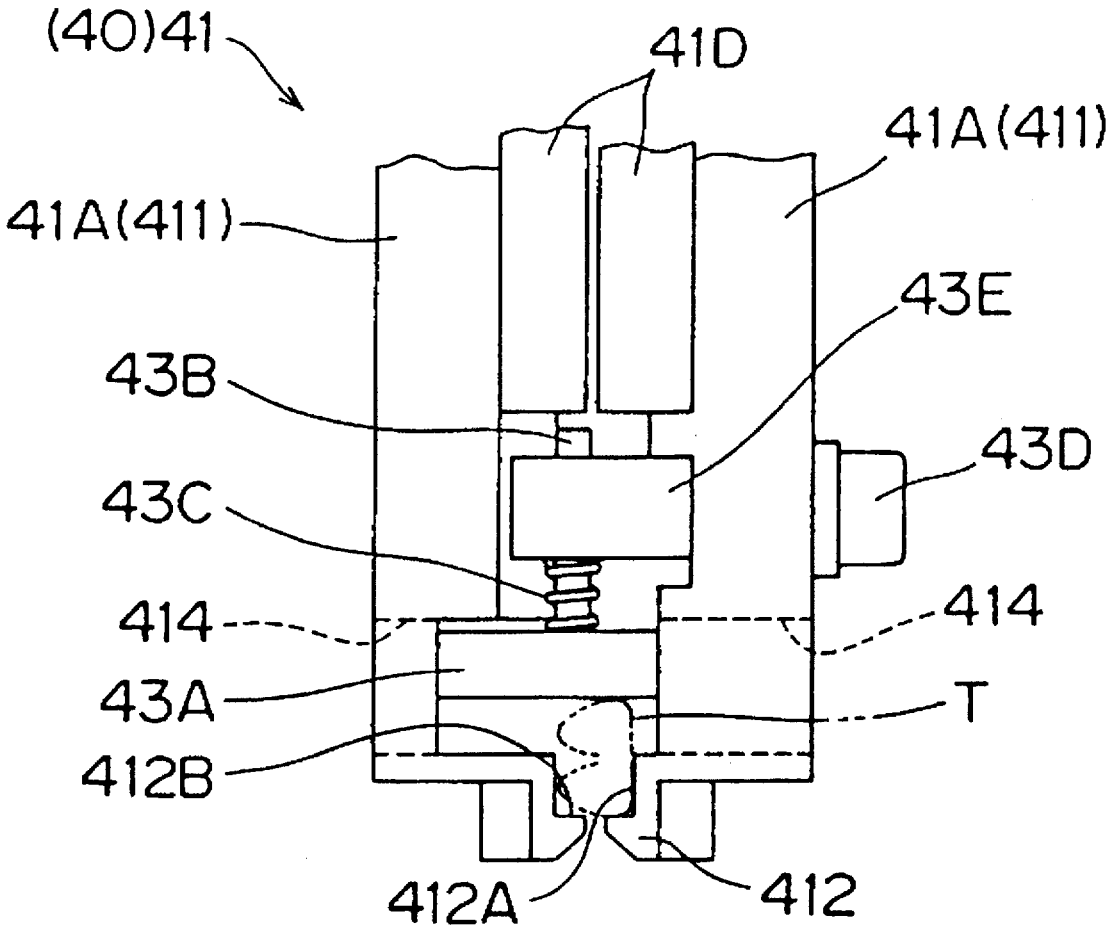
FIG. 8 is a schematic front view illustrating how a wired terminal is guided in the embodiment in FIG. 1.

FIGS. 4 to 6 and 9 to 16 are schematic side views each illustrating a terminal inserting operation in the embodiment shown in FIG. 1, and FIGS. 7 and 8 are schematic front views each illustrating how a wired terminal is guided in the embodiment in FIG. 1.

Referring to FIG. 2, when the wire delivering device 100 delivers, to the terminal positioning device 30, a wired terminal T conveyed by the wire conveying device 13 of the automatic wire harness producing system 10, the terminal positioning device 30 holds the sheathed wire W between the centering clamp 34 opposite to the holding jaw 31 and the wire bringing clamp 35 opposite to the centering clamp 34. Further, those positions of the wired terminal T to be held by the chucks 41, 42 of the terminal inserting device 40, are defined by the holding jaw 31. A specific wired terminal T may be inverted to correct the insertion position. Such an inverting process is disclosed in detail in Japanese Patent Laid-Open Publication No. 6-187852 previously proposed by the applicant of the present invention.

In this embodiment, a wired terminal T is held at only the tip thereof between the holding jaw 31 and is exposed at the base side thereof. Referring to FIG. 5, when the terminal positioning step is finished, the chucks 41, 42 of the terminal inserting device 40 are conveyed by the conveyance drive devices 40A (See FIG. 2). As shown in FIG. 6, the terminal chuck 41 guidably holds the exposed portion of the wired terminal T held by the holding jaw 31, and the wire chuck 42 holds that portion of the sheathed wire W between the centering clamp 34 and the wire bringing clamp 35. At this time, the pressing plate 43A of the rotation regulating mechanism 43 comes in contact with the wired terminal T and is moved slightly upward against the bias force of the compression coiled spring 43C. After the holding jaw 31 has released the wired terminal T, the wired terminal T is held by the bias force of the compression coiled spring 43C between the pressing plate 43A and the bottom surfaces 412B. As shown in FIG. 7, at this holding step, the wired terminal T is held between the end surfaces 412A of the guide portions 412 of the terminal chuck 41, and is also resiliently pressed to the bottom surfaces 412B by the pressing plate 43A of the rotation regulating mechanism 43. As a result, the rotation regulating mechanism 43 regulates the displacement of the wired terminal T in the state where the wired terminal is only relatively movable with respect to the terminal chuck when the wire chuck acts an inserting operation. Further, the wired terminal T is surrounded by the end surfaces 412A, the bottom surfaces 412B and the pressing plate 43A. As shown in FIG. 8, even though the terminal positioning device 30 inverts the wired terminal T such that its posture is rotated, for example, by 90° around the axis thereof, the displacement around the axis is regulated by the pressing plate 43A of the rotation regulating mechanism 43.

As anticipated from FIGS. 7 and 8, even though wired terminals T are different in size or shape with one another, any of such wired terminals T can also guidably be held, without hindrance, using the terminal chuck 41 according to this embodiment. That is, any of such wired terminals T can be held as resiliently pushed to the bottom surfaces 412B by the pressing plate 43A.

Figure 9:
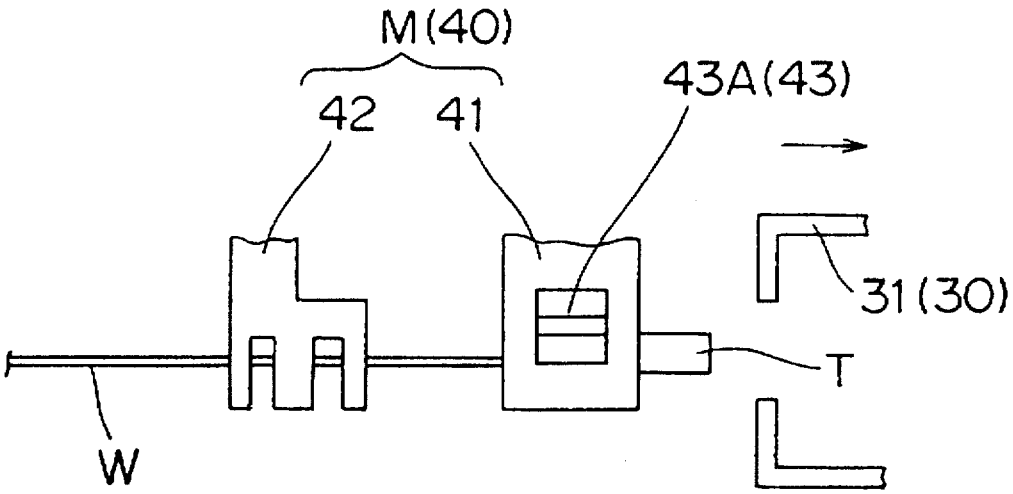
FIG. 9 is a schematic side view illustrating a terminal inserting operation in the embodiment in FIG. 1.

Referring to FIG. 9, when the wired terminal T and the sheathed wire W are held by the chucks 41, 42, the holding jaws 31 and the clamps 34, 35 of the terminal positioning device 30 are opened such that the wired terminal T and the sheathed wire W are delivered to the terminal inserting device 40. This embodiment is arranged such that the holding jaw 31 is displaced in the direction away from the chucks 41, 42 (rightward in FIG. 9) such that the holding jaw 31 does not interfere with the terminal chuck 41.

Figure 10:
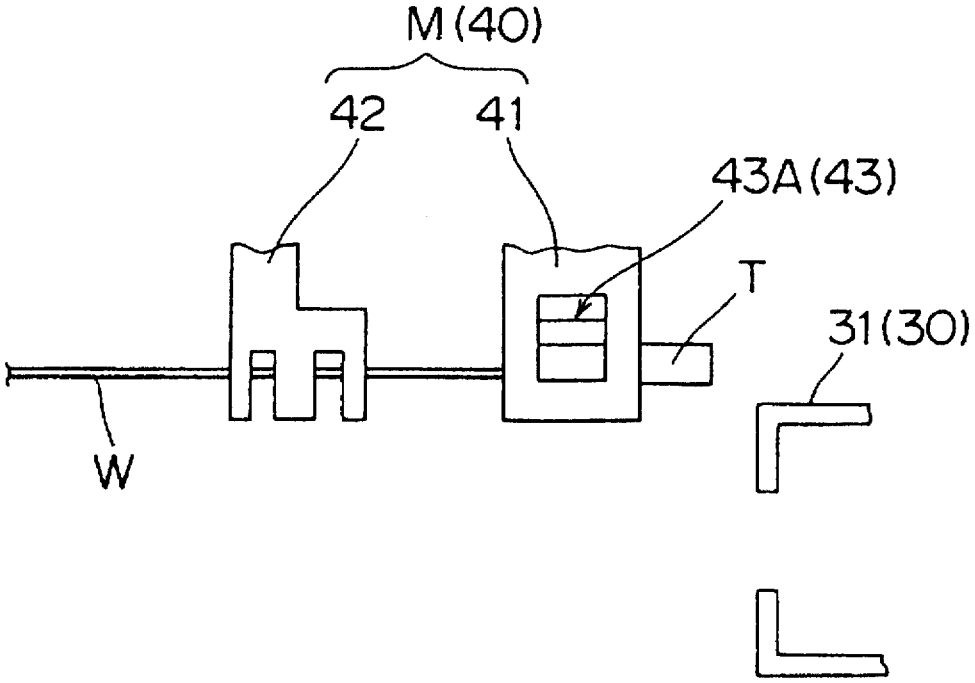
FIG. 10 is a schematic side view illustrating a terminal inserting operation in the embodiment in FIG. 1.
Figure 11:
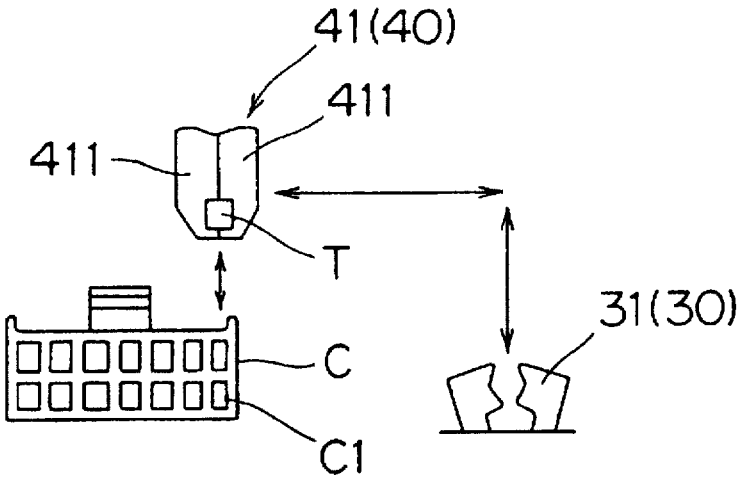
FIG. 11 is a schematic side view illustrating a terminal inserting operation in the embodiment in FIG. 1.

Referring to FIGS. 10, 11, the terminal inserting device 40 which has received the wired terminal T from the terminal positioning device 30, is conveyed, by the conveyance drive devices 40A (See FIG. 2), to the connector housing C positioned by a positioning device (not shown) such that the tip of the wired terminal T is faced to the corresponding terminal housing chamber C1.

Figure 12:
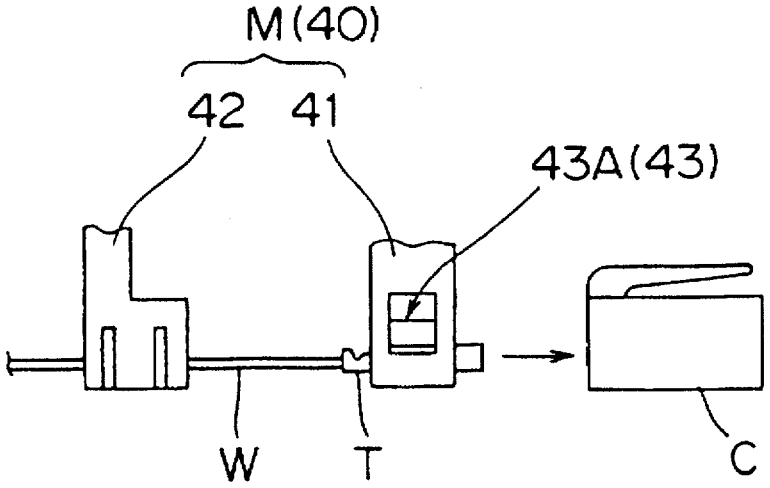
FIG. 12 is a schematic side view illustrating a terminal inserting operation in the embodiment in FIG. 1.
Figure 13:
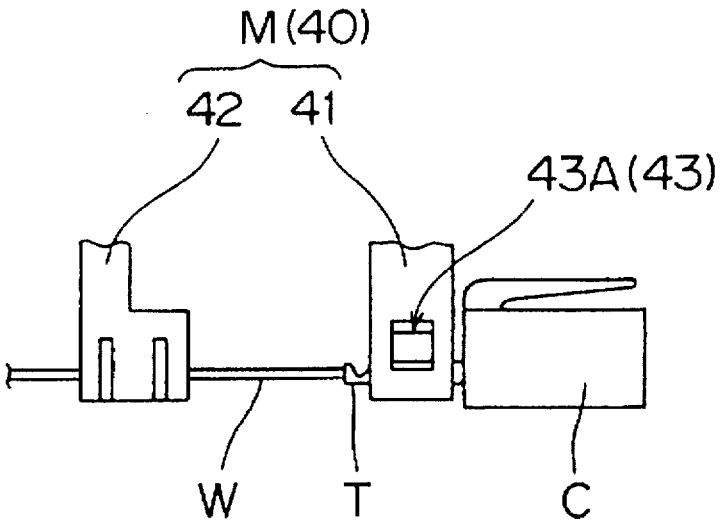
FIG. 13 is a schematic side view illustrating a terminal inserting operation in the embodiment in FIG. 1.
Figure 14:
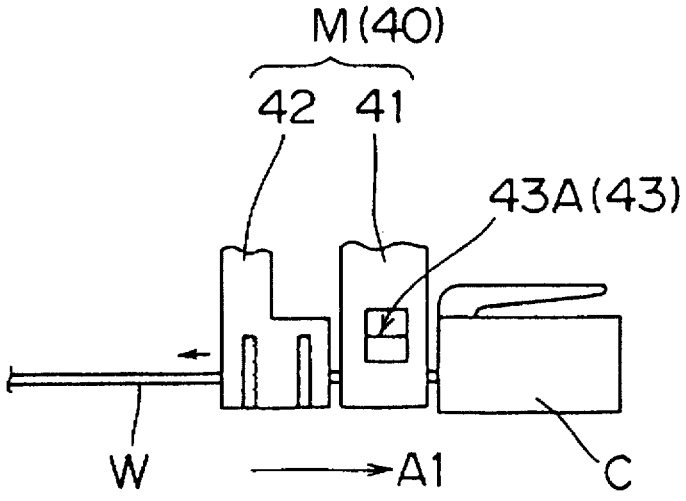
FIG. 14 is a schematic side view illustrating a terminal inserting operation in the embodiment in FIG. 1.
Figure 15:
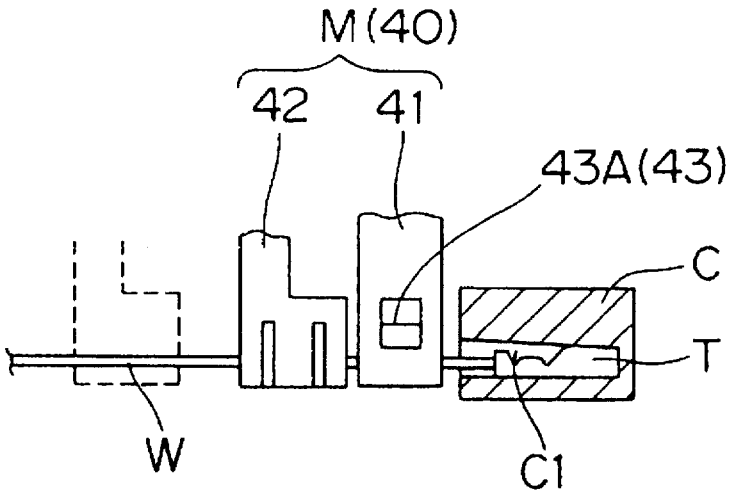
FIG. 15 is a schematic side view illustrating a terminal inserting operation in the embodiment in FIG. 1.

With the state above-mentioned, the terminal chuck 41 gets close to the connector housing C as shown in FIG. 12, the tip of the wired terminal T is guided to the entrance of the terminal housing chamber C1 as shown in FIG. 13, and the wire chuck 42 is driven toward the terminal chuck 41 as shown by an arrow A1 in FIG. 14, such that the inserting operation is carried out. In such an insertion step, the rotation regulating mechanism 43 regulates the positional shift of the wired terminal T. Accordingly, the wired terminal T is precisely inserted, in a proper posture, into the terminal housing chamber C1 of the connector housing C as shown in FIG. 15. After the wired terminal T has been separated, in the insertion step, from the pressing plate 43A of the rotation regulating mechanism 43, the pressing plate 43A is received by the shoulder portions 413 of the terminal chuck 41 (See FIG. 1). This involves no likelihood that the pressing plate 43A interferes with the sheathed wire W.

Figure 16:
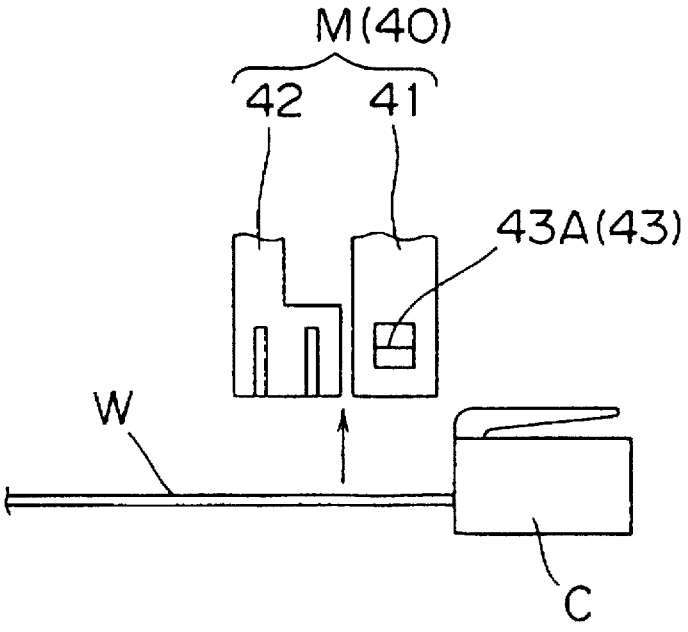
FIG. 16 is a schematic side view illustrating a terminal inserting operation in the embodiment in FIG. 1.

Referring to FIG. 16, when the insertion step is finished, the chucks 41, 42 are opened and upwardly retreated, thus proceeding to the next insertion step.

The insertion step above-mentioned may be carried out simultaneously or sequentially in the manipulators M by the conveyance drive devices 40A.

As discussed in the foregoing, according to the arrangement of this embodiment, the rotation regulating mechanism 43 regulates, in a predetermined state, the displacement of the wired terminal T delivered to the terminal chuck 41. Accordingly, even though the wired terminal T is an inverted one, such a terminal can advantageously be inserted with the inverted posture thereof securely maintained.

Further, the biasing members (pressing plate 43A, compression coiled spring 43C) of the rotation regulating mechanism 43, can resiliently bias a wired terminal T to the bottom surfaces 412B with the wired terminal T surrounded by the biasing members together with the holding jaws 41A and the bottom surfaces 412B extended from the holding jaws 41A. Thus, regardless of the size and posture of a wired terminal T, the wired terminal T positioned by the terminal positioning device 30, can advantageously be inserted as maintained in a proper posture.

Thus, the terminal inserting apparatus according to this embodiment can produce the remarkable effects that any of various types of wired terminals T can securely be received from the terminal positioning device 30 having an inverting function and can be inserted, in a proper posture, into the connector housing C.

As a modification of the embodiment above-mentioned, the bottom surface 412B may be formed at only one of the pair of holding jaws 41A. Accordingly, the present invention is not limited to the above embodiment alone. The foregoing embodiment is a mere illustrative example for disclosing the technical nature of the present invention, and the present invention should not be interpreted in a narrow sense of meaning by limiting to this practical example only. Hence, the true spirit and scope of the present invention should be limited only by the description of the accompanying claims.

We claim:

1. A terminal inserting apparatus for inserting a wired terminal, formed by a terminal attached to an end of an electric wire, into a connector housing after receiving the wired terminal from a terminal positioning device capable of positioning the wired terminal by rotating the wired terminal around an axis of an electric wire forming the wired terminal, said terminal inserting apparatus comprising:

a terminal chuck for guidably holding a wired terminal carried by the terminal positioning device;

a wire chuck for holding an electric wire of the wired terminal carried by the terminal positioning device, and for inserting the wired terminal into a connector housing in association with said terminal chuck by which the wired terminal is being held; and rotation regulating means disposed on said terminal chuck for regulating a displacement of the wired terminal held by said terminal chuck in a state where the wired terminal is only relatively movable with respect to said terminal chuck when said wire chuck acts an inserting operation.

2. A terminal inserting apparatus according to claim 1, wherein said terminal chuck includes a pair of end surfaces for positioning, from sideways, the wired terminal held by the terminal positioning device; and a bottom surface, extended from at least one of the end surfaces, for receiving a bottom of the wired terminal held between said end surfaces; and said rotation regulating means includes a biasing member for resiliently biasing the wired terminal held between the end surfaces onto said bottom surface.

3. A terminal inserting apparatus according to claim 1, wherein said terminal and wire chucks form a pair of manipulators.

4. A terminal inserting apparatus according to claim 1, wherein said rotation regulating means includes a pressing plate disposed between respective jaws of said terminal chuck, a slide pin for guiding the pressing plate, a compression coiled spring put on the slide pin, and a stationary piece secured to one of the jaws for making the compression coiled spring flex between the pressing plate and the stationary piece.

5. A terminal inserting apparatus according to claim 4, wherein the slide pin extends vertically and has a base end secured to the pressing plate and an upper end passing through the stationary piece such that the upper end is relatively displaceable with respect to the stationary piece.

6. A terminal inserting apparatus according to claim 4, wherein the pressing plate is formed by a plate member, substantially in a T shape in plan view, having a drive portion which is capable of press-contacting with a shoulder portion formed at each jaw and a pressing portion, extending from the drive portion, which is capable of press-contacting with a top surface of the wired terminal.

7. A terminal inserting apparatus according to claim 6, wherein the drive portion is, in association with said wire chuck, capable of holding the wired terminal.

* * * * *